United States Patent [19]

Haldemann et al.

[11] Patent Number: 4,522,423

[45] Date of Patent: Jun. 11, 1985

[54] SAFETY BINDING OF A BOOT ON A SKI

[75] Inventors: Gaston Haldemann, Fürigen; Francois Wirz, Savièse, both of Switzerland

[73] Assignee: Haldemann A.G., Stans, Switzerland

[21] Appl. No.: 458,908

[22] Filed: Jan. 18, 1983

[30] Foreign Application Priority Data

Jan. 27, 1982 [CH] Switzerland ..... 495/82

[51] Int. Cl.[3] ..... A63C 9/08

[52] U.S. Cl. ..... 280/624

[58] Field of Search ..... 280/613, 624, 625, 629, 280/634, 616; 292/48, 196

[56] References Cited

U.S. PATENT DOCUMENTS

| | | | |
|---|---|---|---|
| 4,143,886 | 3/1979 | Salomon | 280/624 |
| 4,145,071 | 3/1979 | Salomon | 240/624 |
| 4,176,857 | 12/1979 | Bodendorfer | 280/624 |

FOREIGN PATENT DOCUMENTS

| | | | |
|---|---|---|---|
| 407471 | 6/1923 | Fed. Rep. of Germany . | |
| 1951155 | 6/1970 | Fed. Rep. of Germany . | |
| 2643123 | 4/1977 | Fed. Rep. of Germany . | |
| 2907939 | 9/1979 | Fed. Rep. of Germany | 280/612 |
| 2357270 | 2/1978 | France . | |
| 2420358 | 10/1979 | France . | |
| 2434634 | 3/1980 | France . | |
| 2445730 | 8/1980 | France . | |
| 2332773 | 9/1980 | France . | |

*Primary Examiner*—Joseph F. Peters, Jr.
*Assistant Examiner*—Joseph G. McCarthy
*Attorney, Agent, or Firm*—Young & Thompson

[57] ABSTRACT

The present invention relates to a safety binding of a boot on a ski comprising two lateral clamps (4) movably mounted under the action of an elastic member (28) parallel to the plane of the ski (3) between a closed position in which the clamps coact with the sole of the boot and an open position. Each clamp (4) is connected to one end of a longitudinally slidable strip (45) by means of articulatedly interconnected rods. The other end of the strip coacts with a crank (29–30) subjected to the action of the resilient member, whereby this crank has two stable positions corresponding to the respective open and closed positions of the clamps.

13 Claims, 19 Drawing Figures

FIG. 7A
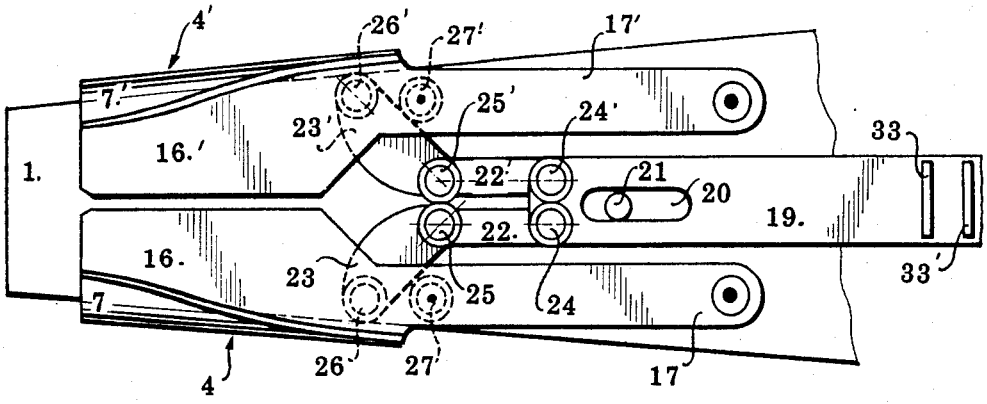
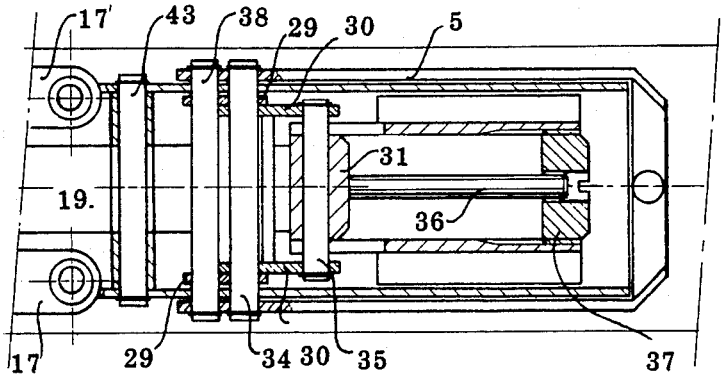
FIG. 7B
FIG. 8
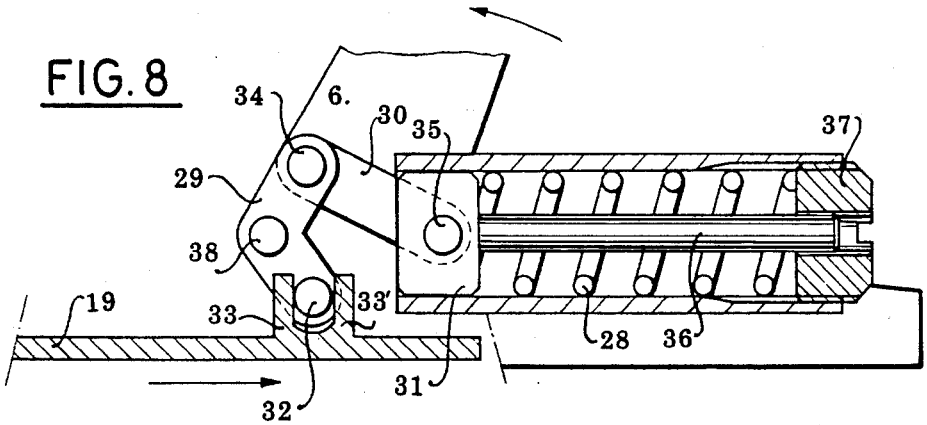

SAFETY BINDING OF A BOOT ON A SKI

The present invention relates to a safety binding of a boot on a ski with lateral clamps, that is, in which two lateral clamps are movably mounted parallel to the plane of the ski, under the influence of a resilient member, between a closed position in which they cooperate with the sole of the boot and an open position in which the latter is completely freed.

The principle of bindings with lateral clamps has been known for a number of years, particularly from French Pat. Nos. 1,411,638 and 2,021,237, but has not until the present been sufficiently satisfactorily and safely embodied to be successfully commercialized. Certain improvements have been made for example to avoid the need for the user to reset the binding once the latter has been voluntarily opened or in the case of a fall, as described in French Pat. Nos. 2,332,773 and 2,445,730, or to improve the disengagement of the boot when opening the safety binding, as described in French Pat. No. 2,420,358.

Nevertheless, the known bindings with lateral clamps all have one or more of the following drawbacks: the possibility of insufficient lateral disengagement from the boot, the latter being hindered by the presence of the clamps even when these are in open position, too great complication of the system and accordingly a non-competitive sales price, the need to use a special plate to fix to the sole of the boot, etc. Finally, all these known bindings use movable members such as wedges, inclined members, etc., which are in frictional contact with each other, which tends to pose more or less long-term problems when wear begins to impede the normal operation of the movable members.

Accordingly, the object of this invention tending to alleviate simultaneously all of the preceding disadvantages, consists in a binding of the type described above and which is characterized by the fact that each lateral clamp is carried by an arm pivotally mounted on the ski and is connected to one end of a longitudinally slidable strip by means of articulatedly interconnected rods, and by the fact that the other end of the strip coacts with a crank subjected to the action of a resilient member, whereby this crank has two stable positions corresponding to the respective open and closed positions of the clamps.

According to a first embodiment of the invention, the crank is constituted by an elbowed member of which one end coacts with the strip and the other end is connected by an articulated rod to a piston subjected to the action of a resilient member, this element being pivoted by its elbowed portion on an actuating lever.

According to a second embodiment of the invention, the crank is constituted by a casing containing the resilient member, which has a portion pivoted on a transverse axle fixed to a support secured to the ski and a portion articulated to an actuating lever, the two portions forming the casing sliding longitudinally the one in the other.

The safety binding according to the invention may moreover comprise automatic closure means acting on the crank of said binding.

The accompanying drawings show schematically and by way of example several embodiments of the safety binding according to the invention.

FIGS. 7A and 7B are top plan views of the binding in closed position, showing respectively the lateral clamps and the resilient tension member.

FIG. 8 is a longitudinal cross-sectional view of the resilient tension member with the rod transmission device in the position corresponding to that of FIGS. 7A and 7B.

Figure 1:
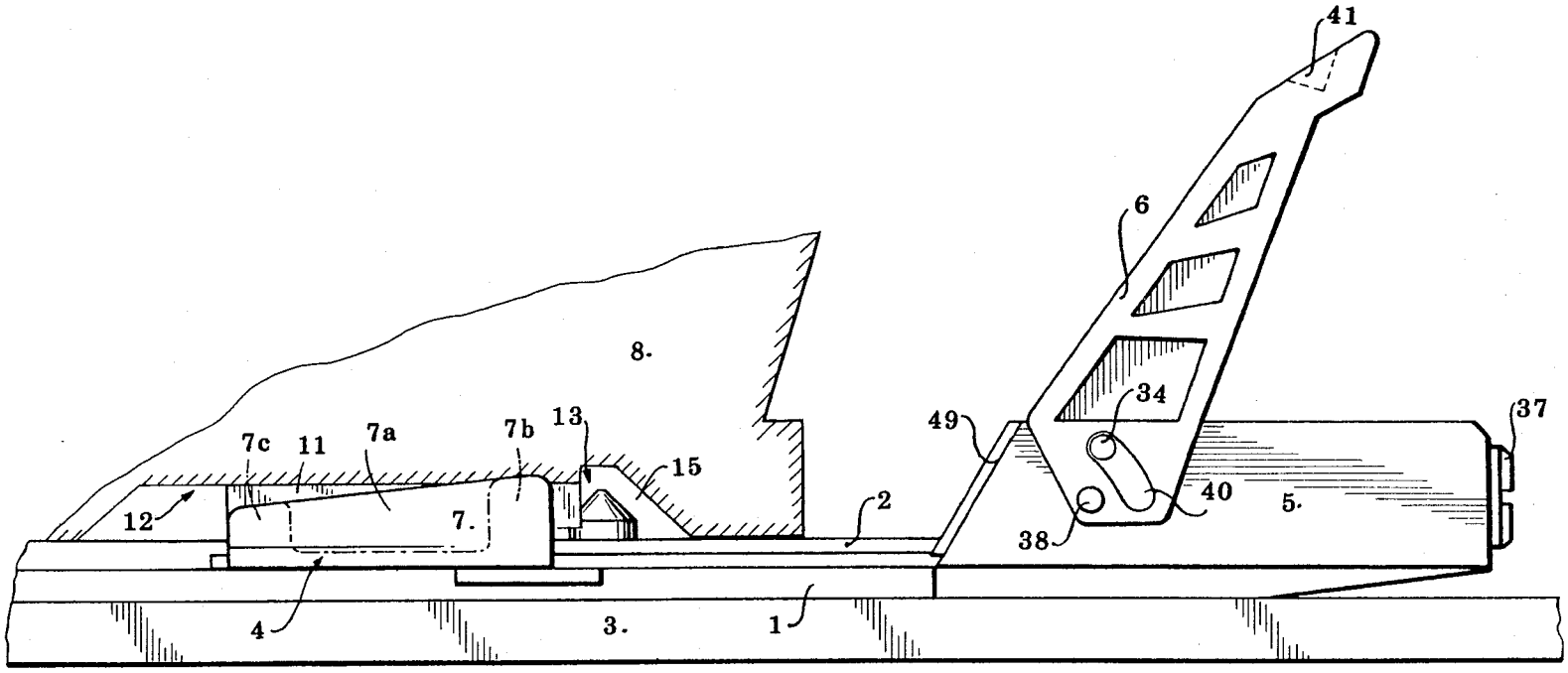
FIG. 1 is an overall side view of a first embodiment of binding according to the invention in closed position on a partially-shown ski boot.

Referring first to FIGS. 1 to 4, the safety binding comprises two base plates 1, 2 secured on a ski 3 and between which are mounted two lateral clamps 4, 4' laterally movable under the influence of a resilient member contained in a casing 5 secured to the ski, the resilient member being adapted to be actuated by a lever 6. Each clamp 4, 4' comprises in the embodiment illustrated by way of example a portion 7, 7' upwardly inwardly inclined and forming with the plane of the ski an acute angle that increases from front to rear so as to impart to this portion a somewhat helical appearance. The minimum angle $\alpha$ may be of the order of about 30°, while the maximum angle $\beta$ may be of the order of about 60°.

According to a modification shown in phantom line in FIG. 1, each clamp 4 can have a hollow medial portion *7a* leaving but two external portions *7b*, *7c* somewhat forming claws.

The ski boot 8 adapted to coact with the clamps described above comprises a sole 9, whose medial portion 10 has lateral edges 11, 11' forming on each side of the sole a ramp making with the plane of the latter an acute angle increasing from front to rear and giving it a shape corresponding to that of the space between the clamps 4, 4' in closed position. Thus, in the operative position shown in FIG. 1, the clamps 4, 4' exactly mate with the lateral ramps 11, 11' of the medial portion 10 of the sole 9 of the boot 8.

Moreover, to ensure easy lateral disengagement of the boot 8 when the clamps are in open position, either as the result of a fall, or deliberately, the sole 9 also has two transverse channels 12, 13 respectively forwardly and rearwardly bounding the medial portion 10. The rear end of this medial portion 10 also has a recess 14, disposed on the longitudinal axis of the sole and which is adapted to coact, in the operative position, with a centering cone 15 secured to the upper plate 2 of the binding, to the rear of the lateral clamps 4, 4' and on the medial longitudinal axis of the ski.

The first embodiment of actuating device for the lateral clamps 4, 4' will now be described with reference to FIGS. 5–8. The clamps 4, 4' whose shape seen from above is conical, opening rearwardly, comprises also hook portions 7, 7' of the clamps 4, 4' clamping in this closed position the edges of the medial portion of the sole of the boot.

Figure 5:
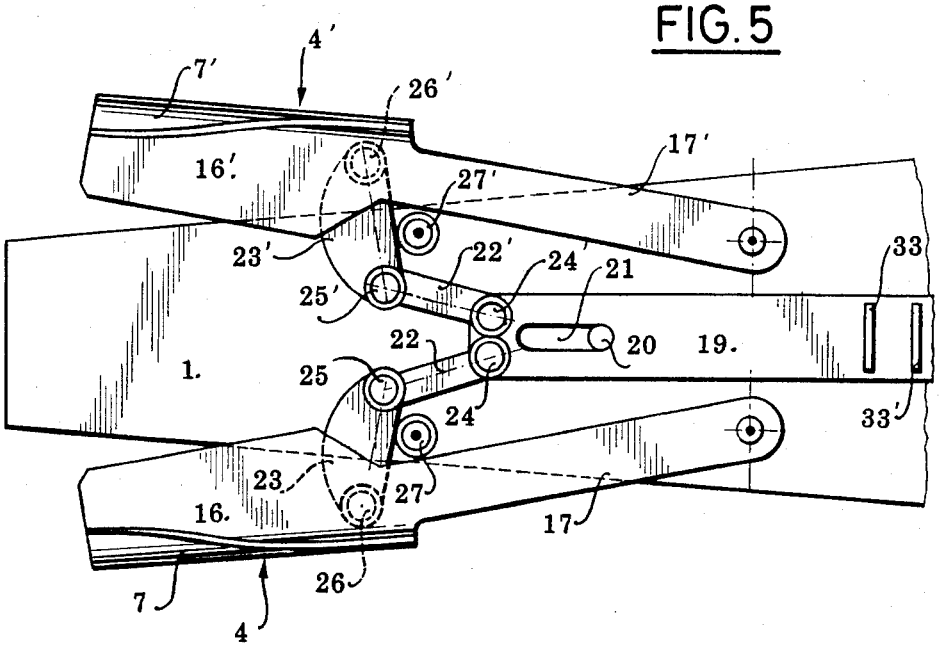
FIG. 5 is a top plan view of the lateral clamps in open position with a first embodiment of their actuating-rod device for the clamps.

As shown in FIGS. 5 and 7A, a strip 19 is longitudinally slidably mounted between the two arms 17, 17' carrying the clamps 4, 4', the sliding movement being centered by a pin 20 fixed to the plate 1 coacting with a longitudinal slot provided in this strip 19. The forward end of this strip 19 is connected to the lateral clamps 4, 4', more particularly to their horizontal portions 16, 16', by means of two pairs of rods 22, 23; 22', 23'. Each pair comprises a first rod 22, 22' whose one end is pivoted to the end of the strip 19, the other end of this rod 22, 22' being itself pivoted on a second rod 23, 23', which is pivoted on the horizontal portion 16, 16' of the jaw 4, 4'. The various pivots are provided by respective vertical pivotal axles 24, 24'; 25, 25'; 26, 26'. Finally, the outer edge of each second rod 23, 23' is in contact with a roller 27, 27' secured to the plate 1 and provided with a ring that turns so as to guide and promote the movement from one position to the other.

Figure 6:
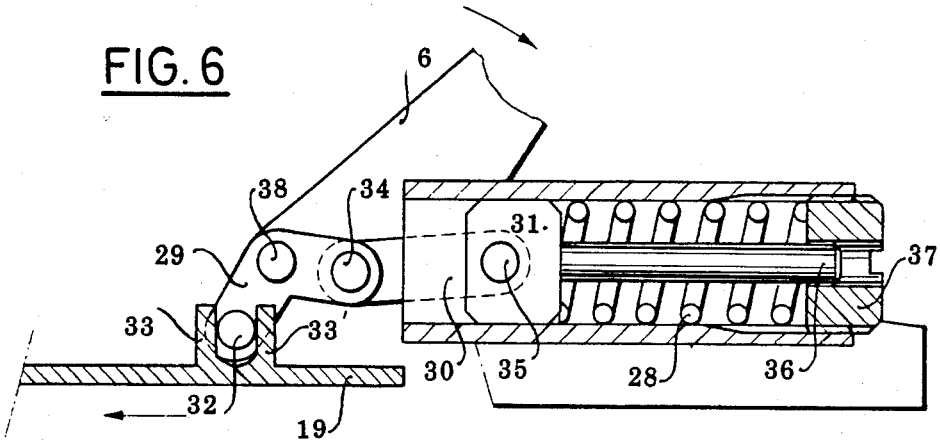
FIG. 6 is a longitudinal cross-sectional view of the resilient tension member with the rod transmission device in the position corresponding to that of FIG. 5.

As shown in FIGS. 6, 7B and 8, the strip 19 is connected by its rear end to a resilient member constituted here by a spring 28 fixedly mounted relative to the ski, longitudinally behind said strip 19. This connection is provided by a crank 19 constituted in this first embodiment by an elbowed member whose one end coacts with strip 19 and whose other end is connected by a rod 30 to a piston 31 fixed to spring 28. More particularly, and as shown in FIG. 7B, a transverse axle 32, secured between the corressponding ends of two cranks 29, 29' laterally disposed parallel to each other, coacts with the channel formed between two transverse projections 33, 33' carried by the rear end of strip 19. Likewise, each of the two cranks 29, 29' is connected to the piston 31 by a rod 30, 30' a transverse axle 34 being secured to the pivot between the rods 29, 29' and the rods 30, 30' and a transverse axle 35 whose ends serve as pivots for the rods 30, 30' coacts with said piston 31. A guide rod 36 which is moreover longitudinally secured by one of its ends to the piston 31, passes through the spring 28 and enters freely at its other end within an adjustment screw 37, adapted to regulate the resilient force of spring 28 by screwing and unscrewing the latter in the wall of casing 5. Finally, the transverse axle 38 connecting the elbowed portions of the two parallel cranks 29, 29' is pivoted in the lateral wall of casing 5.

The connection mechanism between strip 19 and resilient member 28 enables via cranks 29, 29' defining two stable positions corresponding to the respective open and closed positions (FIGS. 6 and 8) of the lateral clamps 4, 4'.

As shown in FIG. 1, the manipulable lever 6 is pivotally mounted about the ends of axle 38 outside casing 5, and is pierced on each side by a slightly arcuate opening 40 in which move the ends of the transverse axle 34 serving as pivot between the two cranks 29, 29' and the two rods 30, 30'.

The binding of the boot 8 on ski 3 is achieved by placing the former between the open lateral clamps 4, 4' such that the boot is centered thanks to the centering cone 15 coacting with the corresponding recess 14 provided at the rear of the medial portion 10 of boot 9. It then suffices to pull on the tension lever 6 to raise it and thereby to effect reversal of the position of the cranks 29, 29' which displaces rearwardly the strip 19 (see FIG. 8) thereby to close clamps 4, 4' on the medial portion 10 of the sole 9 of the boot 8.

Figure 2:
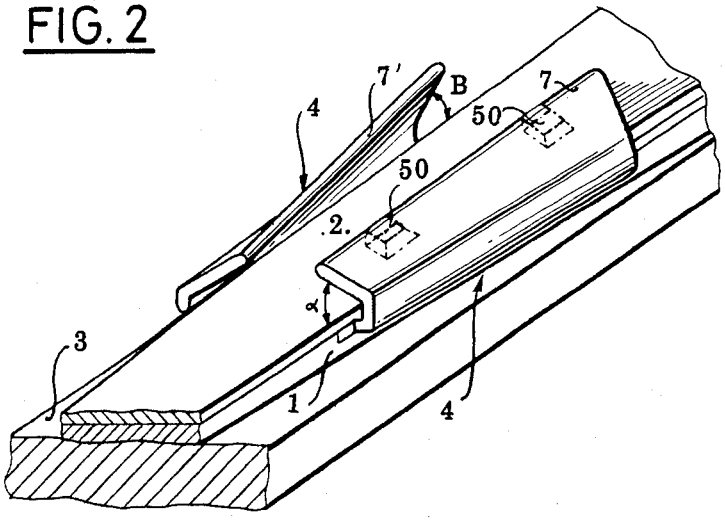
FIG. 2 is a perspective view showing the shape of the two lateral clamps.
Figure 3:
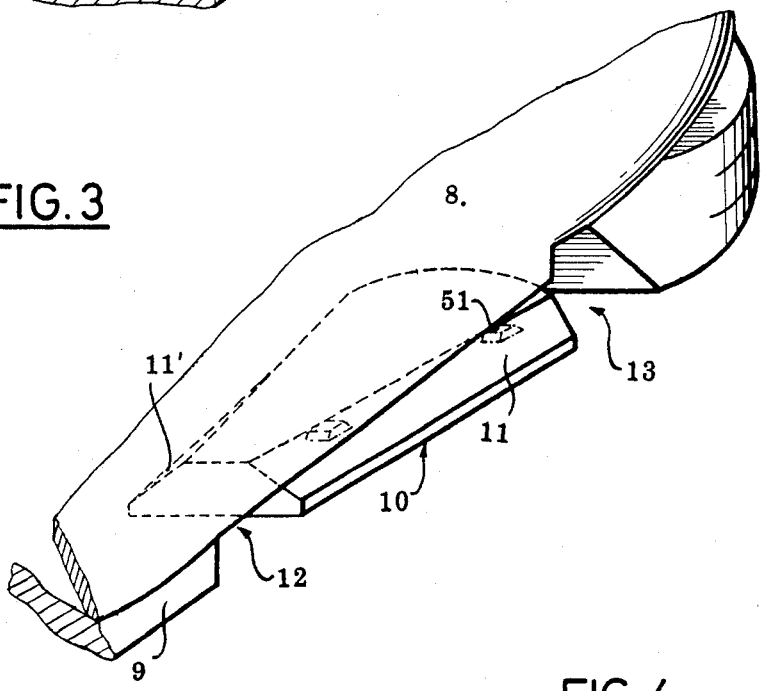
FIGS. 3 and 4 are respectively perspective and bottom views of the sole of the ski boot.
Figure 4:
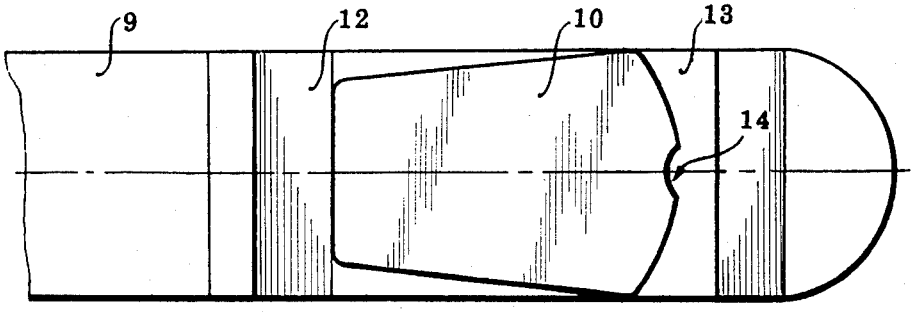

According to a modification shown in phantom line in FIGS. 2 and 3, the upper edge of the portion 7 of each clamp 4 may have two open recesses 50 approximately square or rectangular in shape, and whose lateral internal walls are inwardly flared, with slopes of about 45°. These recesses 50 are adapted to coact in operative position with cleats 51 of a shape corresponding to those of the recesses. In this modification, the torsional force in case of a fall is better transmitted to the clamps, and moreover the centering of the boot is improved.

The arrangement of the connection of strip 19 to resilient means 28 by means of a crank system permitting movement of the bearing axis of the rod connected to said resilient member, provides a lever arm which changes gradually, thus progressively decreasing the moment of force necessary to pass from the open position to the closed position and vice versa. The opening or closing of the clamps is thus automatically effected immediately after passing the equilibrium point of the crank (reversal point). It will be seen that the spring 28 is less compressed in the operative position (FIG. 8) than in the open position (FIG. 6) and accordingly less mechanically stressed, which tends to improve its longevity.

Moreover, the system of rods 22, 22'; 23, 23' to effect connection between the forward end of strip 19 and the clamps 4, 4' permits maximum opening of the latter for a very small longitudinal movement of the strip 19 and thus of spring 28. This is important to permit complete disengagement of the boot when the clamps are in the open position, either by deliberate manipulation of lever 6 by lowering it, for example by pushing the point of the ski pole into recess 41 provided for this purpose at the upper end of lever 6 and pushing downwardly on the latter, or because of a fall that actuates the safety system. Indeed, the length of the medial portion 10 of the sole 9 being less than the minimum distance between the clamps 4, 4' in the open position, the boot may enjoy a rotation of 90° to each side of the ski above the clamps 4, 4' thanks to the presence of the transverse channels 12, 13 forwardly and rearwardly delimiting this medial portion 10, which permits disengagement of the boot in no matter what position.

Thus, the use of articulated rods permits achieving a longer lifetime for the device, friction being substantially reduced with respect to known systems.

Figure 9:
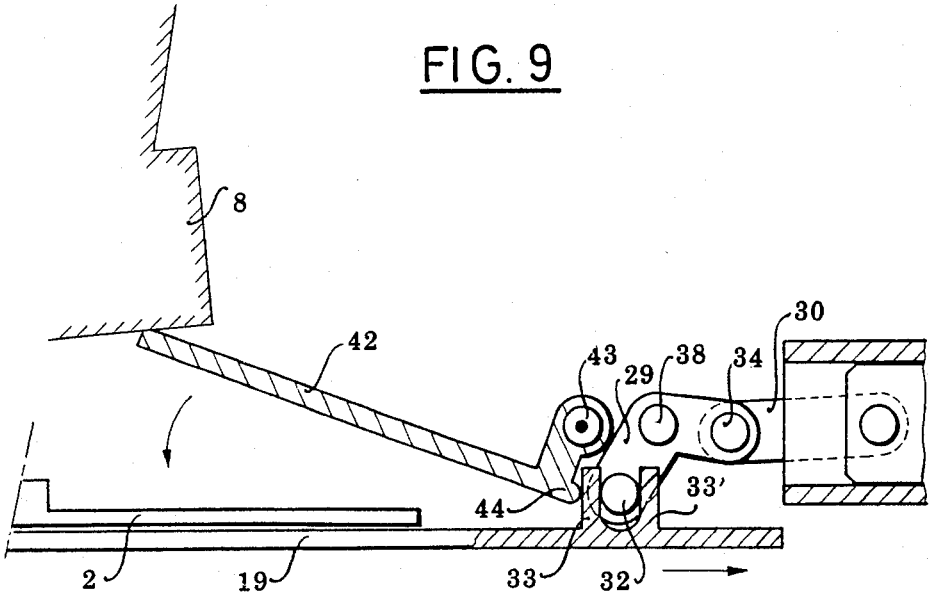
FIGS. 9 and 10 are longitudinal cross-sectional views showing the automatic donning device, respectively in released and locked position.
Figure 10:
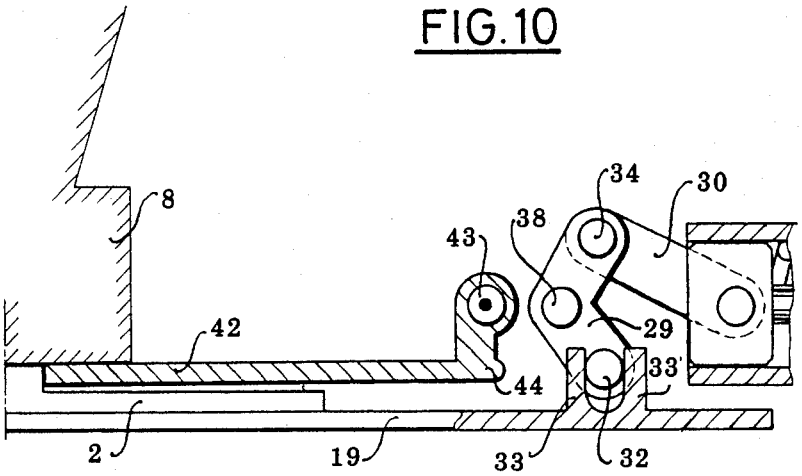

In this first embodiment of binding according to the invention, it is also possible to provide a system for automatic donning, making it unnecessary for the user to manipulate the lever. Contrary to known systems, which are based on the retention provided by the resilient member, the automatic closing means shown in FIGS. 9 and 10 is adapted to push lightly the strip 19 to reverse the tension position thanks to the presence of the crank. This automatic closure means may be comprised for example by a lever 42 articulated about a transverse axis 43 fixed relative to the ski and having a heel 44 coacting in the open position of the clamps with the forward transverse projection 33 of strip 19 (see FIG. 9). To lock the binding automatically, it then suffices to lower the lever 42 by applying the heel of the boot 8 to its forward free end. This movement produces pressure by heel 44 against the transverse projection 33 and thus the rearward displacement of the strip 19 (see FIG. 9), which has the result of swinging the structure to the closed operative position with the strip 19 in its rearwardly urged position (see FIG. 10).

Figure 11:
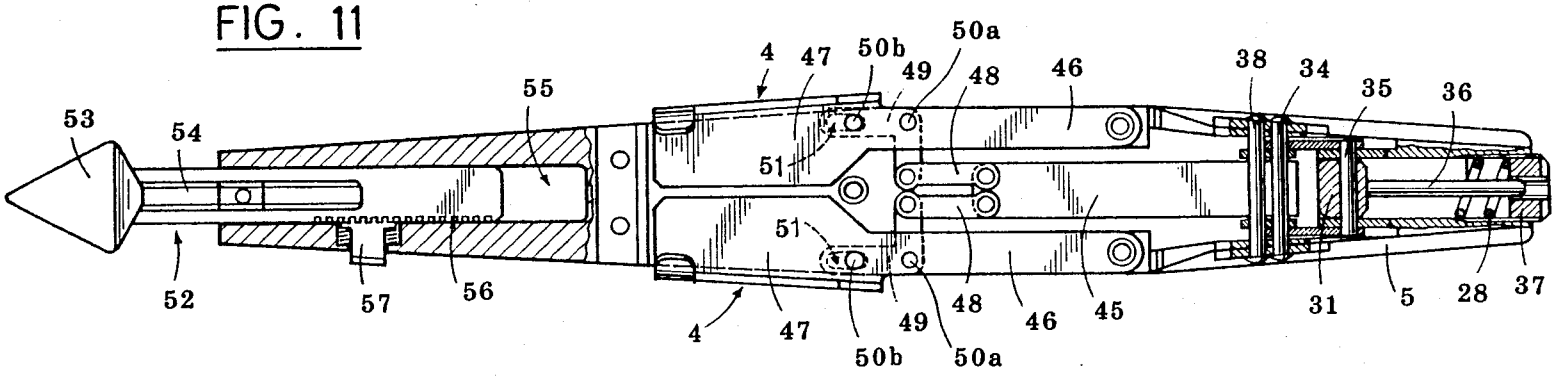
FIGS. 11 and 12 are respective plan and vertical sectional views of a first modification of the clamp-actuating device of FIGS. 5 to 8.
Figure 12:
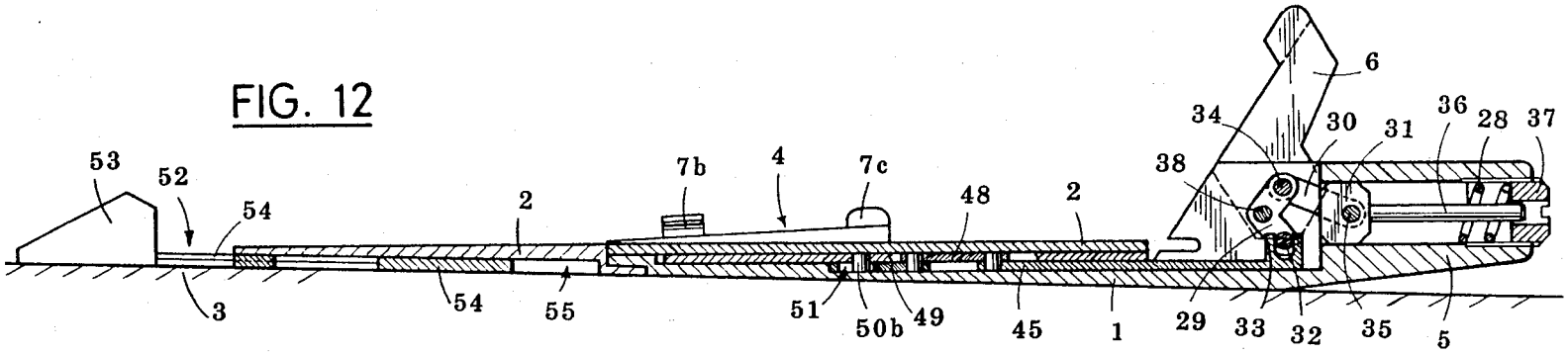

The binding shown in FIGS. 11 and 12 is a modified embodiment of the actuating means for the clamps described above with reference to FIGS. 5 to 8.

In this modification, the sliding strip 45 is connected to arms 46, 46' carrying the clamps 4, 4' by means of two pairs of rods, more particularly to forward portions 47, 47' of these arms whose lateral edges comprise the clamps *7b, 7c*. Each pair of rods comprises a straight rod 48, 48' articulated to the forward end of strip 45 and a right-angle-elbowed rod. This rod 49, 49' is pivoted at the level of its albowed portion about a pin 50*a*, 50*a'* secured to base plate 1. It is moreover pivoted by one of its ends to the forward end of straight rod 48, 48' on the one hand, and by its other end to a pin 50*b*, 50*b'* secured to the forward portion 47, 47' of clamps 4, 4' on the other hand, this pin 50*b*, 50*b'* coacting more particularly with a longitudinally elongated opening 51 in the end of said elbowed rod 49, 49', thereby to permit lateral opening of the clamps 4, 4' under the influence of forward longitudinal translational movement of strip 45. In this modification, the regions of friction are thus decreased which improves the quality of operation of the mechanism and its lifetime. As to the rest, the operation of this embodiment is the same as that previously described, the corresponding parts having the same reference numerals as in the embodiment of FIGS. 5 to 8.

Moreover, in this modification is shown an adjustable stop 52 which may be provided forward of the clamps 4, 4' of the binding. This adjustable stop comprises a block 53 affixed to the forward end of a leaf 54 slidably longitudinally mounted in an axial opening 55 provided below the base plate 2' of the binding. This leaf 54 is provided with teeth 56 adapted to coact with a screw member 57 actuable from the outside so as to fix the longitudinal position of the adjustable stop. Thus, this stop has on the one hand the advantage of facilitating for the skier putting on the binding while determining the forward position against which must be placed the forward end of the boot sole and permits on the other hand, thanks to the external aerodynamic form of the block 53 to deflect snow to the sides and avoids accumulation of the latter against the toe of the boot.

Figure 13:
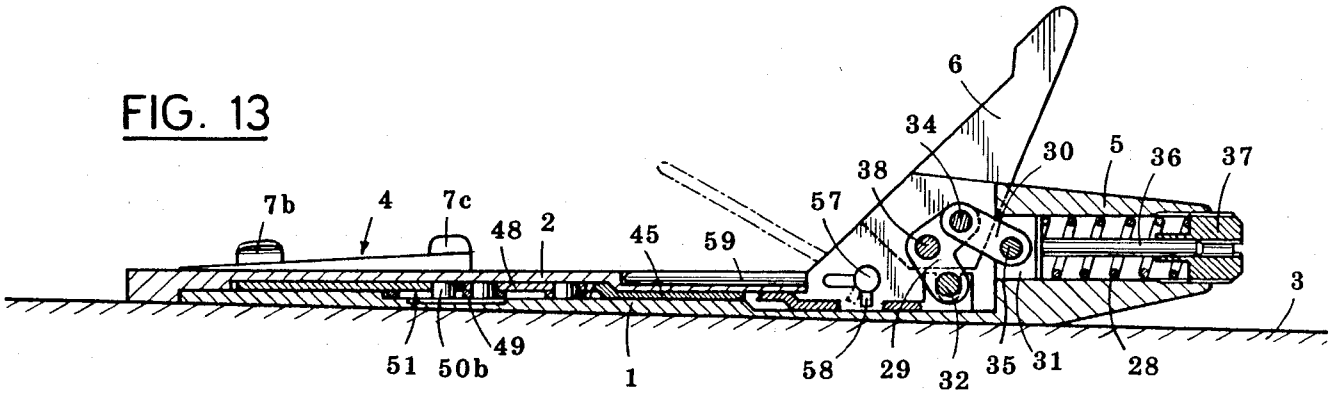
FIGS. 13 and 14 are respective transverse cross-sectional and top plan views of a second modification of the clamp-actuating device of FIGS. 5 to 8.
Figure 14:
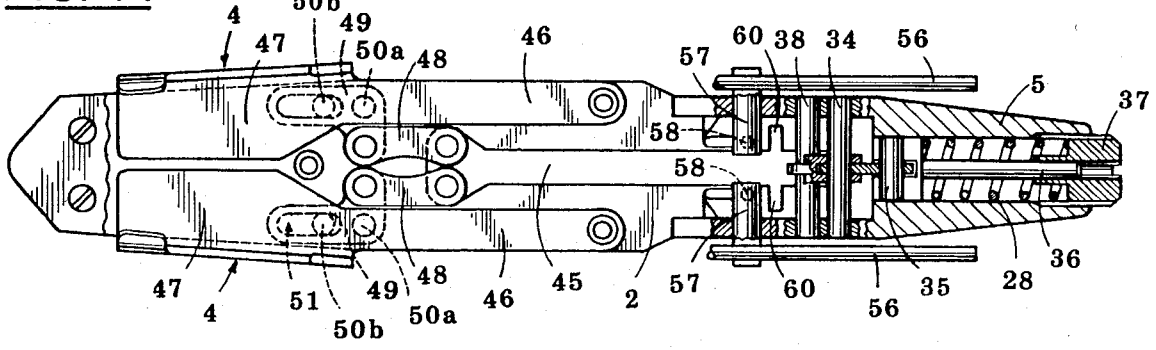

Another modification illustrated in FIGS. 13 and 14 is distinguished from the preceding in that it comprises moreover an automatic closure or "step-in" device for the opened clamps by placing in operative position the ski boot (not shown) on the binding. In contrast to the embodiment of FIGS. 9 and 10 requiring the position of a particular supplemental closure member, there is used in the modification of FIGS. 13 and 14 the horizontal return movement of the ski brake ("stopper"). Thus, the two lateral arms 56, 56' of the stopper are secured for rotation on two cylinders 57, 57' pivotally mounted on their axes in the side walls of casing 5, each cylinder having an actuating pin 58, 58' perpendicular to the axis of said cylinder 57, 57'. Thus, in the non-operative position of the binding (not shown), that is to say when the clamps 4, 4' are open and the strip 45' is in forward position, the stopper is in its active position with the forward portion 59 of the latter in raised position, as shown in phantom line in FIG. 13, and the arms project below the ski. When the skier again puts on his skis, he then presses with his boot on this forward portion 59 of the stopper to return the latter to its illustrated horizontal inactive position, which rotates the transverse cylinders 57, 57' counterclockwise, whereby the pins 58, 58' enter into contact with transverse wings 60, 60' on the strip 45' and push the latter rearwardly to swing the crank 29–30 and thus to close the clamps 4, 4'.

Figure 15:
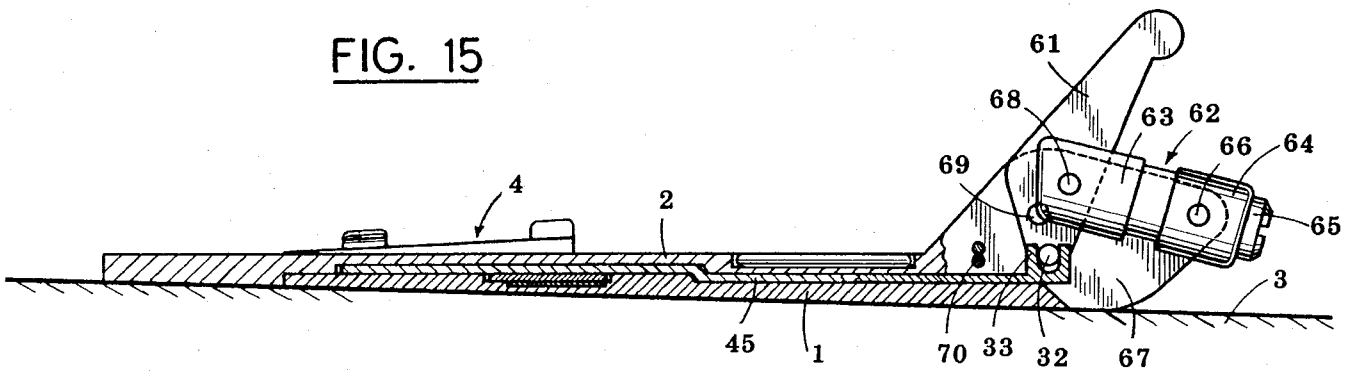
FIGS. 15 and 16 are views respectively in vertical section and in plan partially in horizontal section of a second embodiment of the clamp actuating device.
Figure 16:
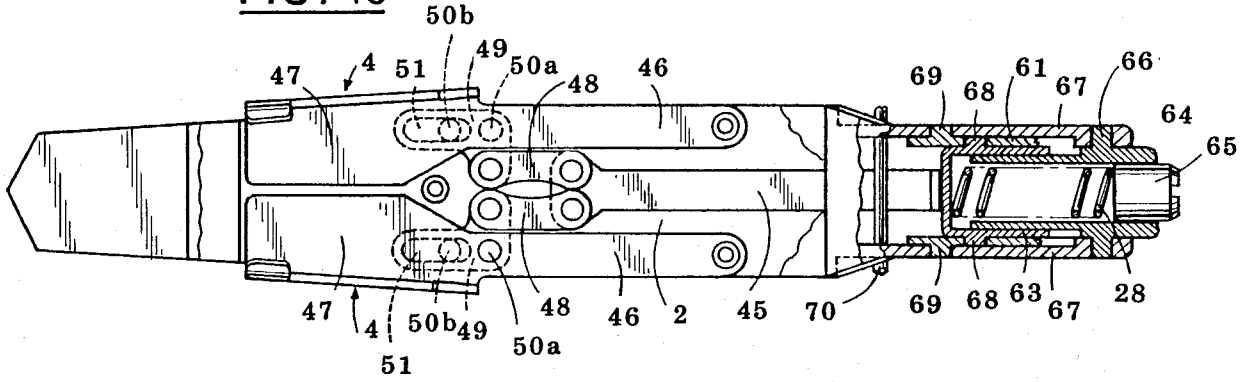

In the embodiment shown in FIGS. 15 and 16, the crank assembly constituted by rods in the embodiments previously described is replaced by another arrangement in which the actuating lever 61 plays the roll of the elbowed rod and the crank system is provided by the fact that the casing 62 containing spring 61 of the binding is pivotally mounted.

More particularly, the pivoting casing-spring 62 is comprised of two parts 63, 64, forward part 63 being slidably displaceable on rear part 64, so as to act as a piston to compress spring 28, the force of the latter being adjustable by means of an adjustment screw 65 accessible from the rear of the device.

The rear portion 64 of the casing-piston 62 is pivotally mounted on transverse axles 66, 66' in two lateral walls 67, 67' secured vertically on the upper surface of ski 3. As to the rear portion 63 of this casing 62, it is pivotally mounted on transverse axles 68, 68' in the lateral walls of the lever 61, the latter being pivotally mounted on axles 69, 69' in the fixed lateral walls 67, 67' of ski 3.

In FIGS. 15 and 16 is shown the position of the device corresponding to the operative position with closed clamps. When the lever 61 is deliberately pushed downwardly, or in case of an opening of the clamps resulting from a fall for example, then the casing-spring 62 moves simultaneously downwardly with lever 61 by pivoting on axles 66, 66' and axles 68, 68' connecting the lever 61 to the casing 62 follow the arc of a circle, which compresses the spring 28 and reverses the crank; thus the transverse pin 32 on the lower end of lever 61 tends to press the actuating strip 45 of clamps 4, 4' forwardly in cooperation with the projection 33 on the strip 45 at its rear end.

Figure 17:
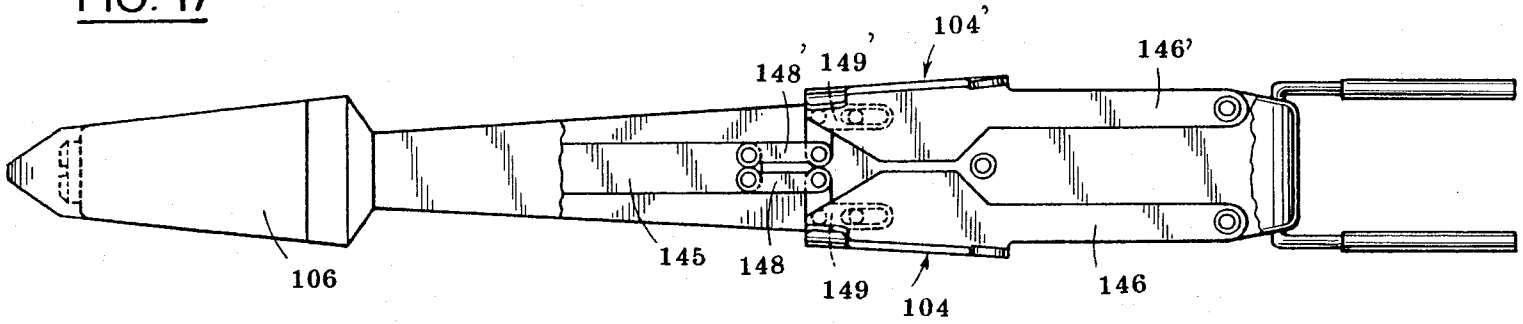
FIGS. 17 and 18 are respectively top plan and side views of another embodiment of the binding according to the invention.
Figure 18:
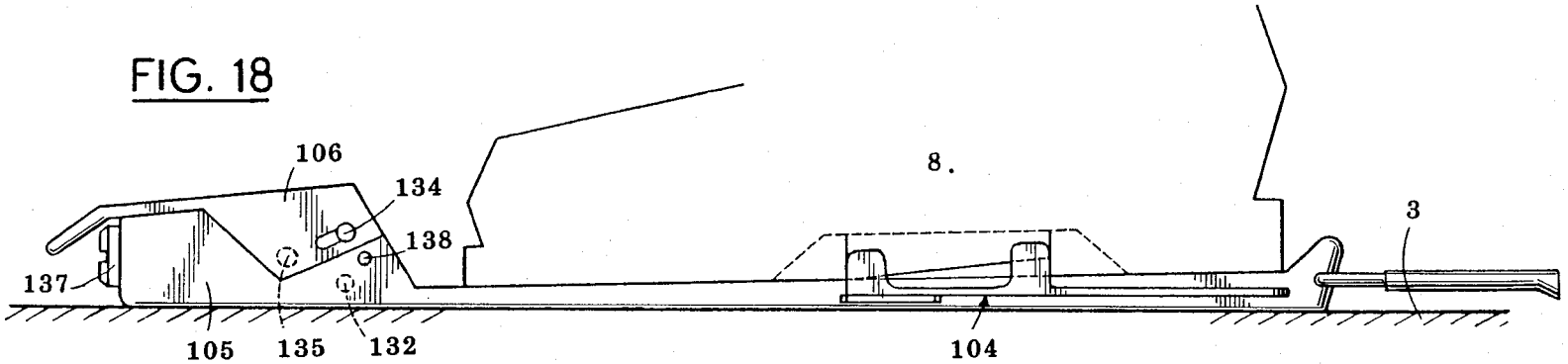

Finally, the embodiment schematically shown in FIGS. 17 and 18 is distinguished from the preceding ones by the fact that the resilient member is disposed forward of the lateral clamps. As shown, the ski boot 8 is secured on the surface of the ski by lateral clamps 4, 4', the latter being subjected to the action of a spring (not shown) disposed in a casing 105 secured forwardly of the toe of the boot 8. As before, the clamps 104, 104' are carried by arms 146, 146' pivotally mounted on the ski (see FIGS. 11 and 12), and are connected to a strip 145 by means of rods 148, 148'; 149, 149', the strip 145 sliding longitudinally and coacting by its forward end with the elastic member (not shown) by means of a crank device which may be similar to the one described in connection with FIGS. 11 and 12, the pivotal axle 138 of lever 106 being of course displaced so that the latter will be located in the lower position (see FIG. 18) when the binding is closed (operative position).

In addition to the advantages already mentioned, namely simplicity of construction and operation, assurance of disengagement of the boot in case of a fall, improved durability thanks to the reduction of friction, the binding device according to the invention has moreover the advantage of being adapted easily to be combined with an automatic donning system for this binding. Thus, given that it suffices for changing from the open position of the clamps to their closed position by acting on the crank, it is possible therefore to provide means acting on this crank, or on the strip connected to it, adapted for example to be actuated by the positioning of the ski boot. Thus, this member may be combined with a braking or stopping device with which the ski is provided, for example as shown in FIGS. 11 and 12, or in any other manner not specifically described herein.

The embodiments of the invention in which an exclusive property or privilege is claimed are defined as follows:

1. Safety binding of a boot on a ski comprising two lateral clamps movably mounted under the influence of a resilient member parallel to the plane of the ski between a closed position in which these clamps coact with the boot sole and an open position, characterized by the fact that each clamp is carried by an arm pivotally mounted on the ski and is connected to one end of a longitudinally slidable strip by means of articulatedly interconnected rods, and by the fact that the other end of the strip coacts with a crank subjected to the action of the resilient member, whereby this crank has two stable positions corresponding to the respectively open and closed positions of the clamp.

2. Binding according to claim 1, characterized by the fact that the crank is actuated by a lever.

3. Binding according to claim 1, characterized by the fact that the crank comprises an elbowed member whose one end bears against the end of the strip and whose other end is articulated on a rod connected to a piston subjected to the action of the resilient member.

4. Binding according to claim 2, characterized by the fact that the crank comprises a casing in two parts containing the elastic member and slidably mounted one in the other, by the fact that one of the parts of the casing is pivotally mounted on a fixed transverse axle and that the other part is pivotally mounted on a transverse axle secured to the lever, this lever being itself pivotally mounted on a fixed transverse axle and bearing against the end of the strip.

5. Binding according to claim 1, characterized by the fact that the end of the strip opposite that coacting with the crank is connected to each lateral clamp by means of two straight rods, the first rod being articulated to the strip and to the second rod, and the latter being articulated to the clamp, and by the fact that the second rod is pivotally mounted by its outer edge about a roller secured to the ski.

6. Binding according to claim 1, characterized by the fact that the end of the strip opposite that coacting with the crank is connected to each lateral clamp by means of straight rods articulated on the end of the strip and an elbowed rod articulated on the one hand to the straight rod and on the other hand to the clamp, and by the fact that the elbowed rod is pivotally mounted by its elbowed portion about a vertical axle secured to the ski and having an elongated opening at its end coacting with a vertical axle secured to the clamp.

7. Binding according to claim 1, characterized by the fact that it comprises an automatic closure device coacting with the strip or the crank and adapted to be actuated by the ski boot.

8. Binding according to claim 7, characterized by the fact that the closure device is a lever pivotally mounted on a transverse axle secured to the ski, this lever having a portion in contact with the strip in the open position of the clamps.

9. Binding according to claim 7 for a ski having a braking device, characterized by the fact that the closure device is constituted by a movable member of the braking device or by a member actuated by this device.

10. Binding according to claim 9, characterized by the fact that the movable member of the braking device is a cylinder fixed for rotation to a lateral arm of the device, this cylinder having at least one lug coacting with the strip in the open position of the clamps.

11. Binding according to claim 1, characterized by the fact that the elastic member is disposed rearwardly of the lateral clamp.

12. Binding according to claim 11, characterized by the fact that a longitudinally adjustable stop is disposed on the ski forward of the lateral clamps.

13. Binding according to claim 1, characterized by the fact that the resilient member is disposed forwardly of the lateral clamps.

* * * * *